US005243903A

United States Patent [19]

Blackmer et al.

[11] Patent Number: 5,243,903

[45] Date of Patent: Sep. 14, 1993

[54] RECYCLABLE CONTAINER COMPACTOR

[76] Inventors: Michael A. Blackmer, P.O. Box 21096, Nashville, Tenn. 37221; Donald M. Cunningham, P.O. Box 839, Fairview, Tenn. 37062; Frank L. Bumbalough, 700 W. Meade Blvd. - #113, Franklin, Tenn. 37064

[21] Appl. No.: 926,590

[22] Filed: Aug. 6, 1992

Related U.S. Application Data

[63] Continuation of Ser. No. 730,499, Jul. 16, 1991, abandoned, which is a continuation-in-part of Ser. No. 614,271, Nov. 19, 1990, abandoned.

[51] Int. Cl.[5] ..... B30B 1/00

[52] U.S. Cl. ..... 100/102; 100/245; 100/265; 297/193

[58] Field of Search ..... 100/102, 245, 265, 226, 100/702, 246; 297/193

[56] References Cited

U.S. PATENT DOCUMENTS

| | | | |
|---|---|---|---|
| 266,566 | 10/1882 | Schmid | D15/123 |
| 2,465,839 | 3/1949 | Bloomfield | 220/1 |
| 3,744,409 | 7/1973 | Bradbury | 100/102 |
| 3,863,563 | 2/1975 | Popeil | 100/102 |
| 4,416,197 | 11/1983 | Kehl | 100/214 |
| 5,009,155 | 4/1991 | Christianson | 100/233 |

*Primary Examiner*—Philip R. Coe
*Assistant Examiner*—Patrick F. Brinson
*Attorney, Agent, or Firm*—Edward D. Lanquist, Jr.; Mark J. Patterson; I. C. Waddey, Jr.

[57] ABSTRACT

The present invention discloses a compactor for recyclable containers that uses gravity instead of brute force to compact recyclable containers. An upper section slides over a lower section. A recyclable container is placed on top of the lower section. The user applies his or her weight to the upper section. As the upper section approaches the lower section, the recyclable container is compacted.

10 Claims, 5 Drawing Sheets

RECYCLABLE CONTAINER COMPACTOR

This patent application is a continuation application of co-pending application Ser. No. 730,499, filed on Jul. 16, 1991, which is now abandoned, which is in turn, a continuation-in-part application of Ser. No. 614,271 filed on Nov. 19, 1990, which is also abandoned.

BACKGROUND OF THE INVENTION

The present invention relates generally to a compactor for recyclable material and more specifically to a compactor for recyclable material that uses the weight of the human body for compaction.

It will be appreciated by those skilled in the art that the public is interested in recycling metal and plastic containers. These recyclable materials generally take the form of aluminum cans, plastic soft drink bottles, and plastic milk jugs. Unfortunately, these empty containers take up a large amount of space. To this end, there have been several attempts to compact these containers.

One such attempt was a hand operated aluminum can crusher that is often advertised on television and in print media. This device has a place for receiving an aluminum can, and a lever is used to apply force to the can.

Another such attempt is the common kitchen trash compactor. Unfortunately, these devices are very complicated and must rely upon electricity. Although these devices may work for entire bunches of trash, they are unsuitable for individual recyclable materials that must be separated by composition.

What is needed, then, is a simple and inexpensive recyclable container compactor. This needed compactor must be easy to use and must not put a strain on the user. This needed compactor must take advantage of gravity. These needed compactor must be usable with small numbers of plastic soft drink bottles, plastic milk jugs, and aluminum cans. This device is presently lacking in the prior art.

SUMMARY OF THE INVENTION

In the present device, an upper section slidably fits over a lower section. The upper section has an opening through which a recyclable container can be placed. An aperture is placed on the base or top side of the lower section to receive the recyclable container. An aperture is placed on the underside of the top of the upper section that will receive the top portion of the recyclable container. A seat is provided on the upper part of the upper section, upon which the user can apply his weight through sitting or standing.

Accordingly, it is an object of the present invention to provide a simple and inexpensive recycle container compactor.

Another object of the present invention is to provide a compactor that is easy to use and does not put strain on the user.

Still another object of the present invention is to provide a compactor that can take advantage of the force of gravity and the user's weight.

Still another object of the present invention is to provide a compactor which can be used with the three main types of recyclable containers.

DESCRIPTION OF THE PREFERRED EMBODIMENT

Figure 1:
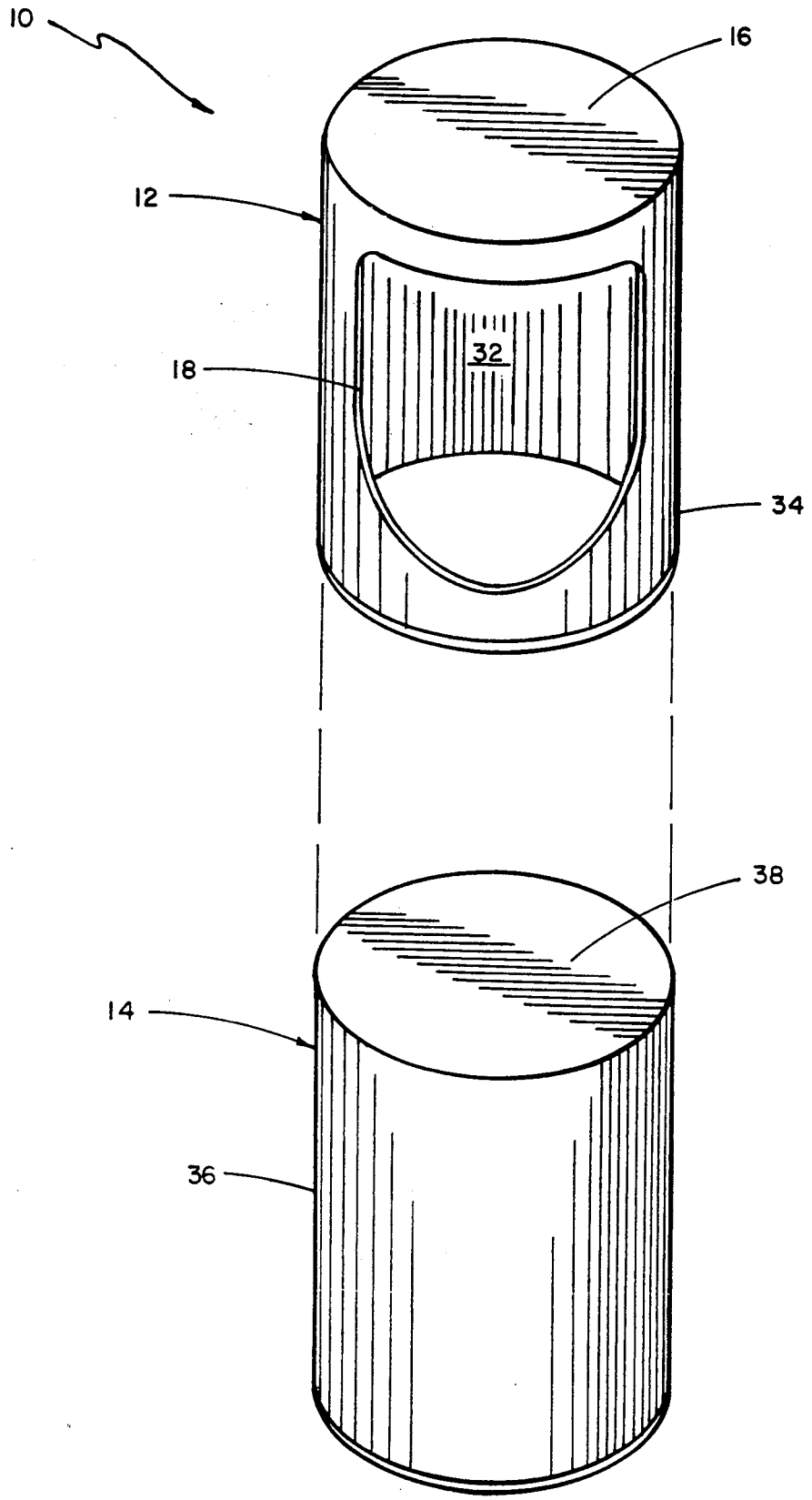
FIG. 1 is a perspective view of the recyclable container compactor of the present invention.

Referring now to FIG. 1, there is shown generally at 10 the recyclable container compactor of the present invention. As can be seen from FIG. 1, upper section 12 slidably fits over lower section 14. Inner walls 32 of sleeve 34 slide along side 36 of lower section 14. Recyclable containers such as aluminum cans, plastic soft drink bottles, and plastic milk jugs, are placed through opening 18 and placed onto lower section 14 at base 38. User then applies his or her weight to seat 16, thereby forcing seat 16 to travel closer to base 38, thereby compacting container.

Figure 2:
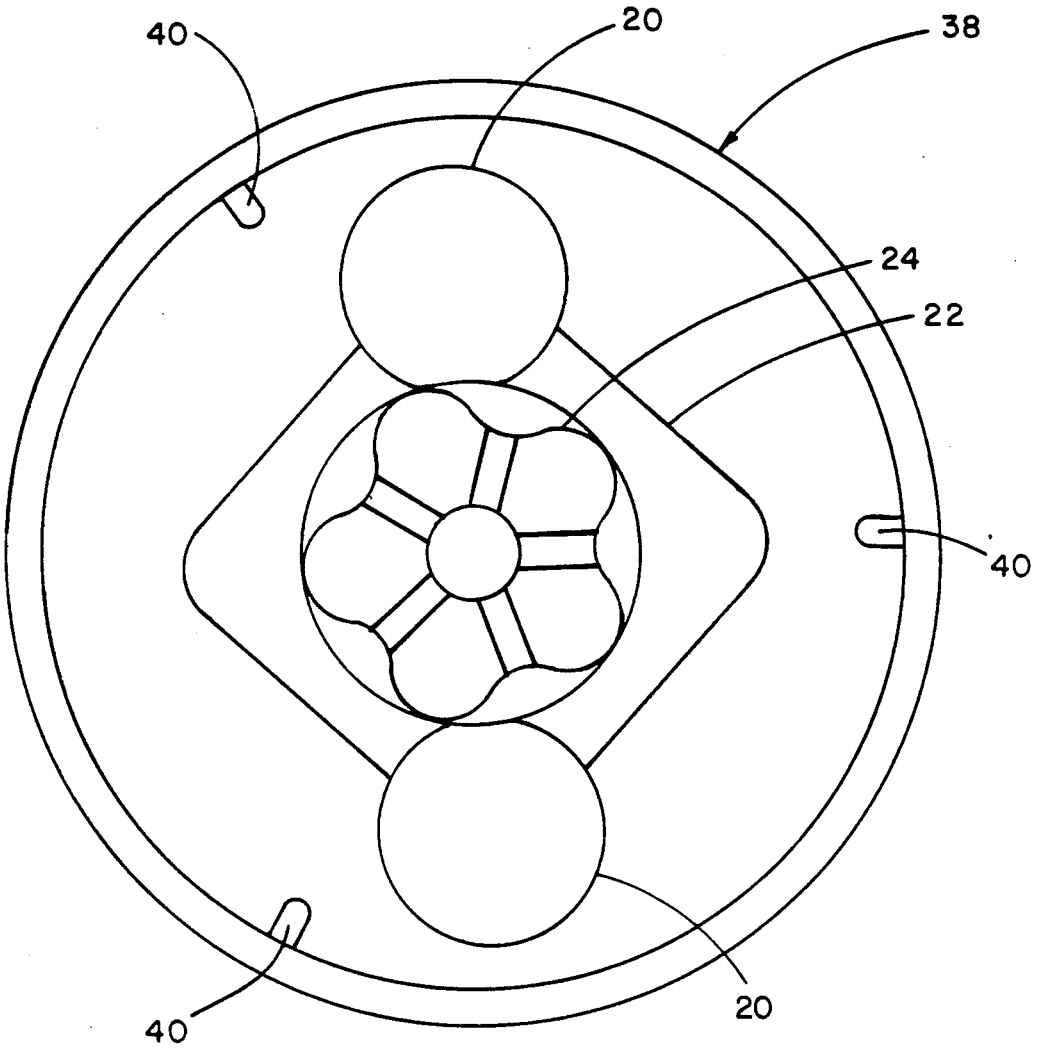
FIG. 2 is a plan view of lower section.

Referring now to FIG. 2, there is shown generally at 38 the base of recycle container compactor 10. FIG. 2 shows recyclable container apertures 20, 22, 24 of the preferred embodiment. Substantially circular can aperture 20 is provided for receiving an aluminum can. Substantially star-shaped aperture 24 is shaped so as to receive a soft drink bottle. Square shaped aperture 22 is shaped so as to receive a plastic milk jug. Apertures 20, 22, and 24 of base 38 can be altered as desired. For example, one or more can apertures 20 can be provided. Conversely, single can aperture 20 can be provided. Plural soft drink bottle apertures 24 and/or milk drug apertures 22 can also be provided. Slots 40 are provided to allow air to escape between upper section 12 and lower section 14. Slots 40 act as a guide to direct the container into the appropriate position.

Figure 3:
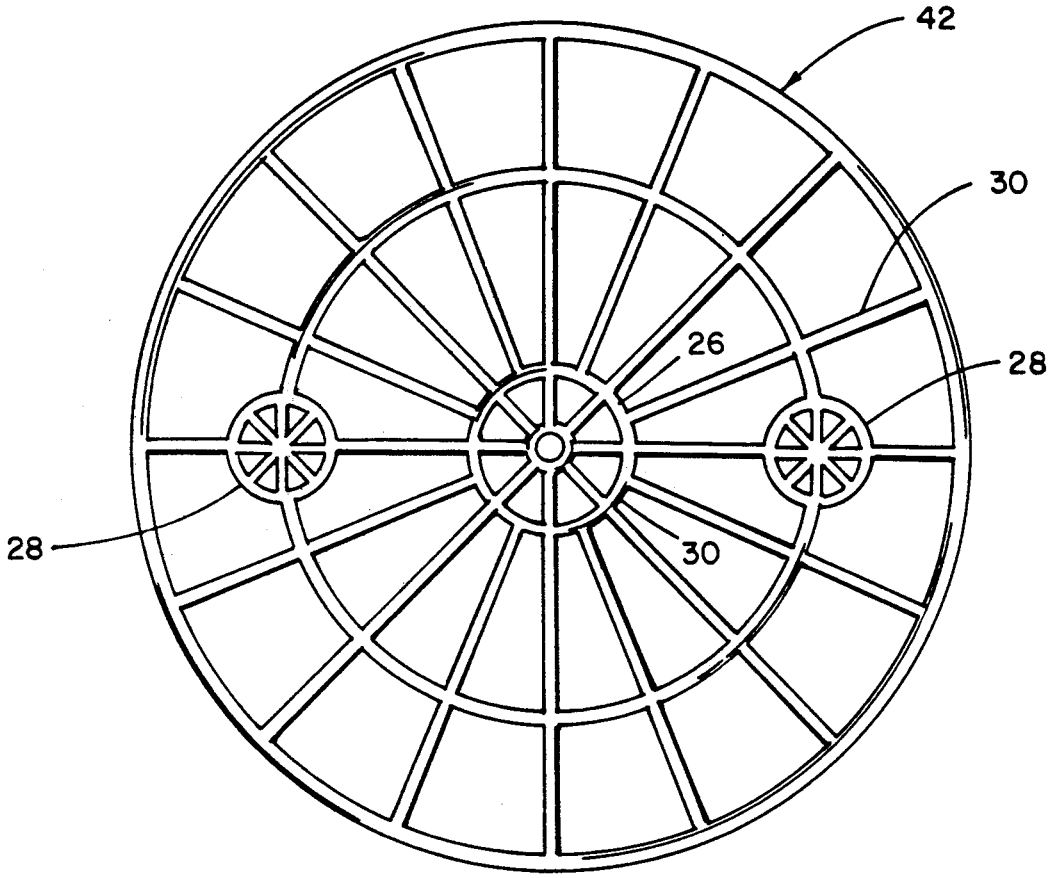
FIG. 3 is an underside view of the upper section of the present invention.

Referring now to FIG. 3, there is shown generally at 42 the underside of upper section 12. Under side 42 in the preferred embodiment is shaped to coincide with base 38 of the preferred embodiment shown in FIG. 2. Because soft drink bottles can be placed in can apertures (20 in FIG. 2), soft drink top apertures 28 are provided for concentric alignment with can apertures 20 in FIG. 2. Similarly, milk top aperture 26 is aligned so that it is substantially in the center of soft drink bottle aperture (24 in FIG. 2) and milk top aperture (26 in FIG. 2). Ribs 30 are placed extensively on underside 42 to allow air to escape from the particular crushed container to allow compaction.

Figure 4:
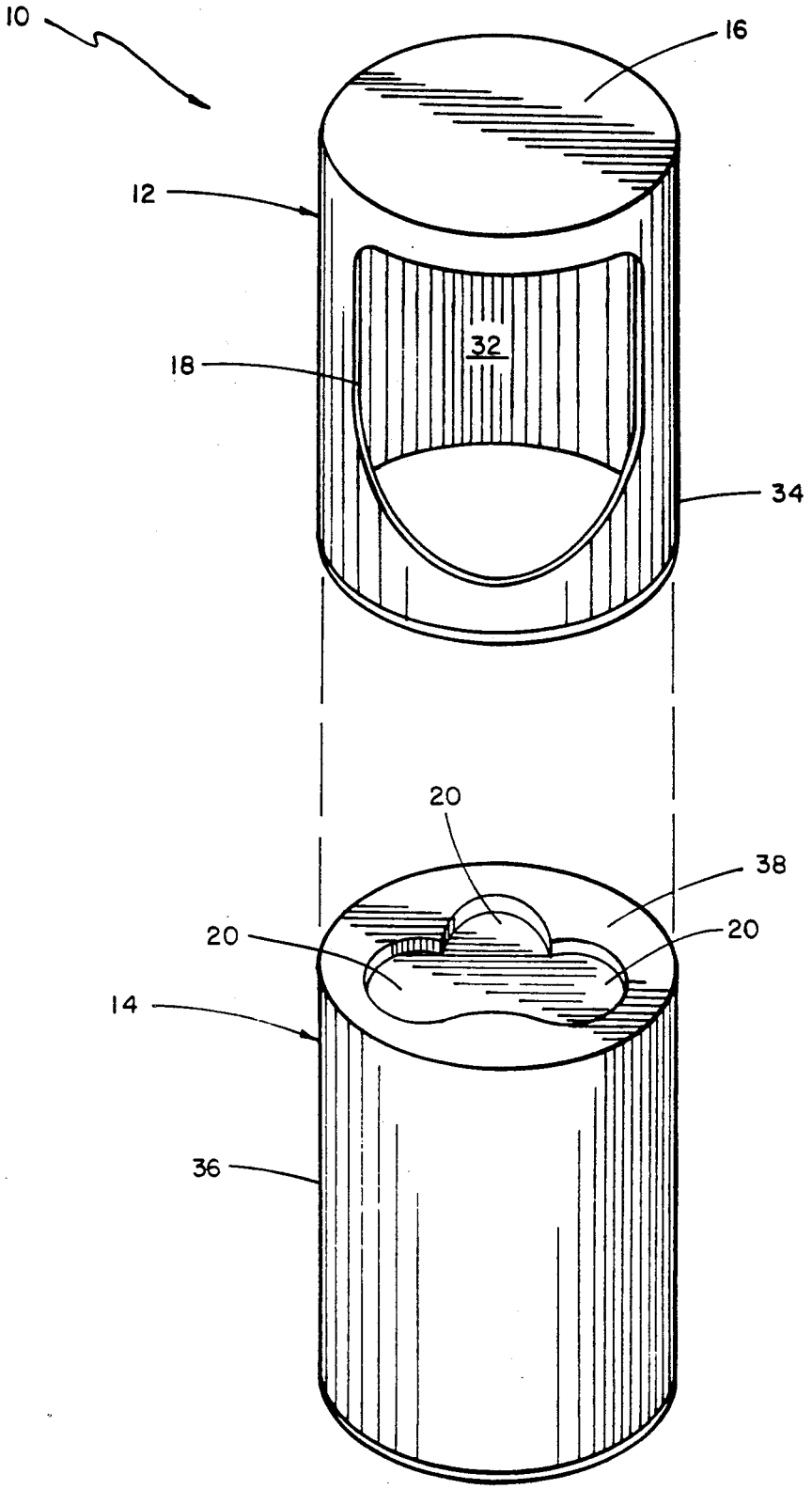
FIG. 4 is an exploded view of the recyclable aluminum can compactor of the present invention.

Referring now to FIG. 4, there is shown generally at 10 an alternate embodiment of the present invention. In this particular instance, underside 42 has three can apertures 20. Realignemnt of this particular shape of can apertures 20 allows device 10 to be used in connection with soft drink bottles and milk bottles as well. Underside 42 of this particular embodiment would be somewhat similar to that shown in FIG. 3, except that apertures 26 would be aligned substantially at the middle of the triangular shape formed by can apertures 20. Soft drink bottle top apertures 28 would be aligned to be substantially concentric to each of can apertures 20.

Figure 5:
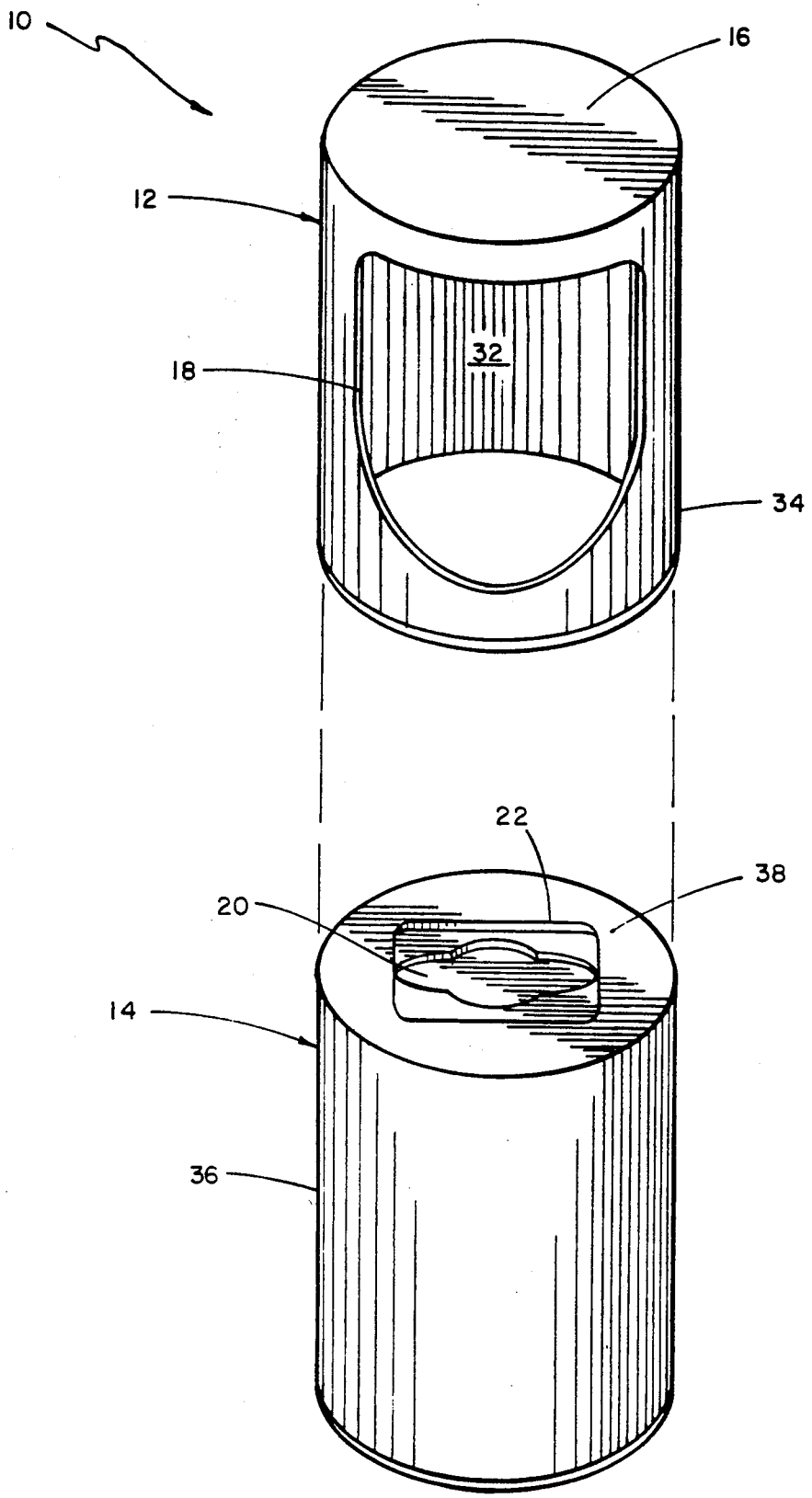
FIG. 5 is an exploded view showing a different type of aperture.

Referring now to FIG. 5, there is shown generally at 20 still another embodiment of the present invention. In this particular instance, soft drink bottle aperture 24 is provided. On either side of aperture 24, part of can aperture 20 is provided. Apertures 20, 24 are bounded by milk jug aperture 22.

User can apply weight to seat 16 by sitting or by standing. For wider versions of device 10, device 10 can be used as a stool. Device 10 can also be used as a seat. Although FIGS. 1–5 show compactor 10 as being round in the plan view, the plan view can be of any shape, as long as upper section 12 slides over lower section 14.

Studies have shown that device 10 will compact, on average, a plastic milk container by sixty-four percent, a plastic soft drink container by sixty-three percent, and an aluminum drink container by seventy-five percent. The device can also be used for compacting small cardboard boxes.

In the preferred embodiment, upper section 12 is substantially 11⅛" in diameter and substantially 14¾" tall. In the preferred embodiment, lower section 14 has a diameter of substantially 10⅞" and a height of substantially 14⅛". However, the diameters of upper section 12 and lower section 14 can be of any size, as long as upper section 12 slidably fits over lower section 14. Opening is can be any size and shape, as long as it is possible to place recyclable containers through it for placement on base 38.

Thus, although there have been described particular embodiments of the present invention of a new and useful recyclable container compacter, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A compactor for a recyclable container comprising:

a. an elongated lower section having a base for placement of said container;

b. an upper section including a sleeve which slidably receives said lower section, said upper section further including a seat integral with the sleeve such that as said seat moves toward said base and said sleeve correspondingly moves along said lower section, said container is compacted by said seat said sleeve having an opening through which said container can be placed upon the lower section; and c. said upper section having an underside of said seat having ribs to allow air to escape from said recyclable container between said ribs as said container is being compacted.

2. The device of claim 1 comprising said base having an aperture for receiving a can.

3. The device of claim 1 comprising said base having an aperture for receiving a drink bottle.

4. The device of claim 1 further comprising said base having an aperture for receiving a milk container.

5. The device of claim 1 further comprising said base having an aperture for receiving a can, a soft drink bottle and a milk container.

6. The device of claim 1 wherein said underside of said seat has an aperture for receiving said container.

7. The device of claim 6 further comprising said underside of said seat having an aperture.

8. A device for compacting a recycle container comprising:

a. an upper section having a seat, a sleeve, and an opening through which said recycle container can be placed;

b. a lower section having a base and a side such that said side is slidably received by said sleeve such that when said seat moves closer to said base during compaction, said sleeve moves along said side;

c. said upper section having an underside of said seat said underside having plural radial ribs and plural concentric ribs to allow air to escape said recyclable container between said ribs during compaction of recyclable container.

9. The device of claim 8 wherein said base comprises an aperture for receiving of a recyclable container.

10. A compactor for recyclable container comprising:

a. a lower section having a side and a base;

b. said base having an aperture for receiving said recyclable container and a continuous side;

c. an upper section comprising a sleeve and a seat, said upper section having opening;

d. said seat having an upper and lower side;

e. said sleeve slidably receiving said side for compacting said recyclable container;

f. said lower side of said seat having ribs to allow air to escape said recyclable container between said ribs during compaction of said recyclable container.

* * * * *